United States Patent [19]

Fernandez

[11] 4,143,742

[45] Mar. 13, 1979

[54] LADDER EXTENSION APPARATUS

[76] Inventor: Albert Fernandez, 2208 W. Virginia Ave., Clarksburg, W. Va. 26301

[21] Appl. No.: 926,307

[22] Filed: Jul. 20, 1978

[51] Int. Cl.[2] ..... E06C 7/44

[52] U.S. Cl. ..... 182/201

[58] Field of Search ..... 182/201, 202, 203, 204; 248/188.6, 188.8, 188.1

[56] References Cited

U.S. PATENT DOCUMENTS

| | | | |
|---|---|---|---|
| 2,567,989 | 9/1951 | Cheek | 182/201 |
| 3,089,563 | 5/1963 | Trumpolt | 182/201 |
| 3,937,298 | 2/1976 | Hurwitz | 182/204 |

*Primary Examiner*—Reinaldo P. Machado

*Attorney, Agent, or Firm*—Buell, Blenko & Ziesenheim

[57] ABSTRACT

A ladder extension device for enabling a ladder to stand upright upon uneven or inclined surfaces is disclosed which is composed of a pair of diametrically opposed side members, preferably L-shaped, connected by hinges and secured about a ladder leg by bolts or other means.

4 Claims, 5 Drawing Figures

10
12
14
18
20
22
24
26
27
28
30
32
34
35

10
12
14
26
27
28
30
34
40
42
44
46
48
50
52
53
54

LADDER EXTENSION APPARATUS

This invention relates to ladder accessories for enabling a ladder to stand upright upon an uneven or inclined surface.

Several types of ladder accessories have been used in the past to permit ladders to stand upright on uneven surfaces. Such accessories range from clamping a board onto one leg of a ladder as disclosed in U.S. Pat. No. 1,290,690 issued Jan. 7, 1919 to two sleeves fitted onto the legs of the ladder and interconnected by a gear attached to a fixed plate on the ladder enabling one sleeve to be adjusted downward while the other extends upward as disclosed in U.S. Pat. No. 3,878,919 issued Apr. 22, 1975. The problem with these devices is that they are designed for ladders of specific dimensions. Any given device in the prior art cannot safely be used on two ladders having legs of differing sizes or shapes.

I propose to provide several embodiments of a ladder extension apparatus, each of which can be used on ladders having legs of varying sizes and shapes.

I also propose to provide a preferred embodiment of the apparatus in which two L-shaped side members are connected by adjustable hinges to provide a U-shaped channel that can be fitted over a variety of ladder legs.

I also propose to provide an embodiment of the apparatus having two side members each having four sides connected at their edges to form a question mark shape joined by hinges thereby permitting the apparatus to be tightly fitted around rectangular shaped ladder legs.

Other details, objects and advantages of the invention will become apparent as the following description of certain preferred embodiments thereof proceeds.

In the accompanying drawings, I have shown certain preferred embodiments wherein.

Figures 1, 2:
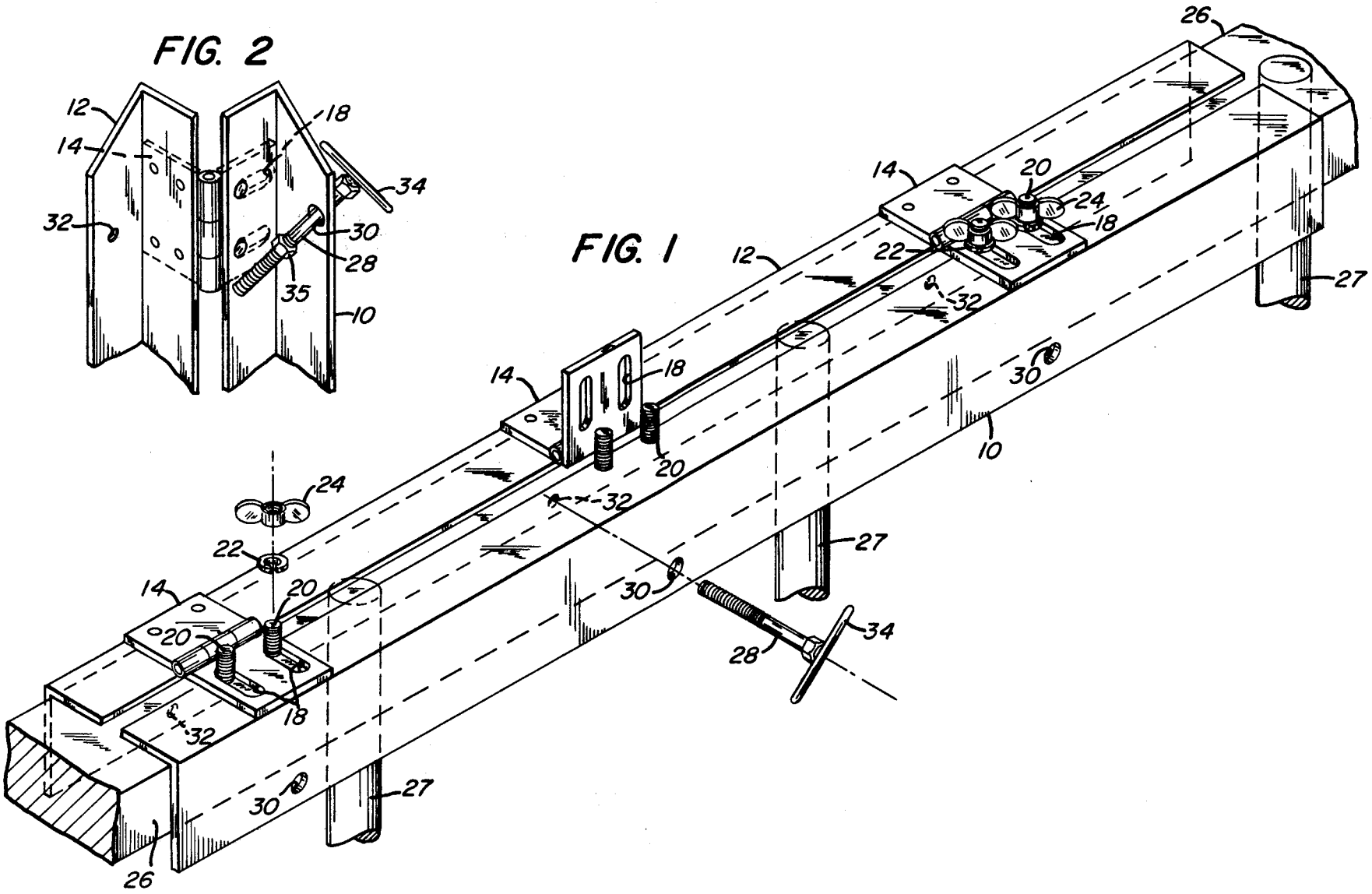
FIGS. 1 and 2 are isometric views of a present preferred embodiment of the apparatus employing L-shaped side members.

Referring to FIGS. 1 and 2 of the drawings, the present preferred embodiment of the ladder extension apparatus there shown comprises two L-shaped side members 10 and 12 connected by adjustable hinges 14 to form a U-shaped channel. Elongated holes 18 are provided in at least one leaf of the hinge 14 to permit the side members 10 and 12 to be positioned at varying distances from each other. This enables the width of the U-shaped channel to be varied so as to accommodate ladder legs of a variety of sizes. The hinges 14 can be attached to the side members 10 and 12 by bolts or rivets. However, the leaf of the hinge containing the elongated holes is fastened to the side member by bolts 20 which are secured by lock washers 22 and wing nuts 24.

Figures 3, 4, 5:
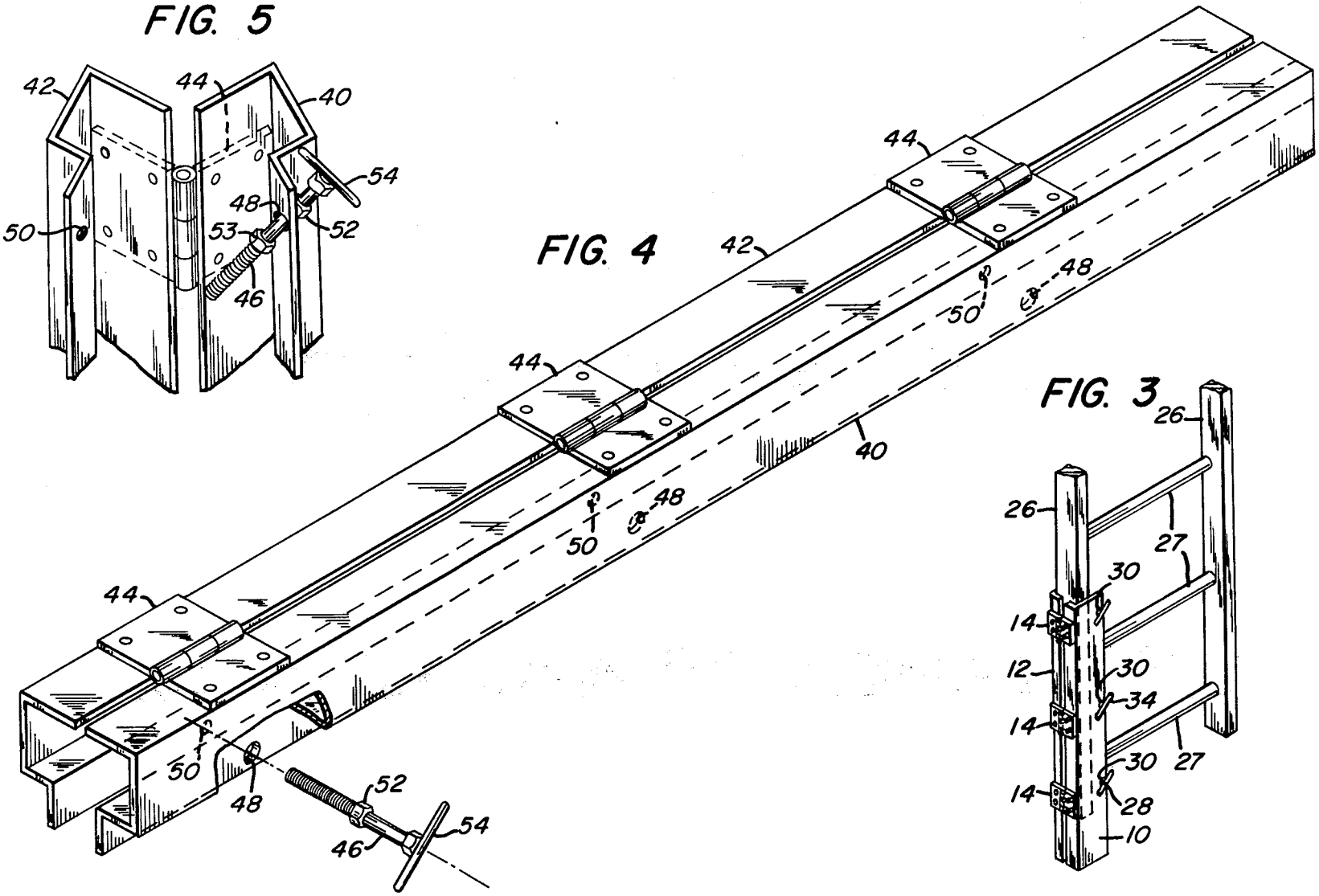
FIG. 3 is an isometric view showing the embodiment of FIGS. 1 and 2 attached to a ladder.
FIGS. 4 and 5 are isometric views of another embodiment.

After the apparatus has been positioned about one leg of a ladder 26, as shown in FIG. 3, it is held in place by bolts 28 passing through oversized holes 30 in one L-shaped side member 10. The oversized holes 30 will permit the bolts 28 to hang loosely from the side member 10 if they are not or cannot be connected to the opposite side member 12 and avoid obstruction with a rung 27. The bolts 28 engage threaded holes 32 in the opposite side member 12. A keeper 35 is provided on each bolt 28 to prevent the bolt from slipping through the hole 30 and getting lost. A handle 34 is provided for each bolt 28 for ease of assembly. I prefer to provide at least three pairs of bolt holes as shown in FIG. 2 so that in the event that one bolt is obstructed by a ladder rung, two bolts will remain to permit the apparatus to be secured to the ladder.

I further prefer to maintain equal spacing between adjacent pairs of holes and to locate the set of hole pairs off-center. Consequently, the distance between the left end of the side member and the left hole pair will be shorter or longer than the distance the right end of the side member and the right hole pair. Such an arrangement will enable the device ro provide a shorter or longer extension depending upon the orientation of the device with respect to the ladder.

A second preferred embodiment is shown in FIGS. 4 and 5 and comprises two side members 40 and 42 connected by hinges 44. Hinges 44 may be replaced by adjustible hinges 14 shown in FIGS. 1 and 2. Both side members 40 and 42 are four sided structures. The side members are formed by adding an angular flange to be L-shaped sides of the first embodiment. The shape of the right side member is that of a question mark. The left side member 42 is a mirror image of the right side member 40. Both side members 40 and 42 are sized to fit securely around the leg of a ladder. This embodiment is also secured about the ladder leg by bolts 46 passing through oversized holes 48 in one side member 40 and engaging threaded holes 50 in the opposite side member 42. A handle 54 can be attached to each bolt 46. A keeper 53 is provided on each bolt to prevent the bolt from falling out of the side member 40. A stopper 52 is also provided to prevent the bolt 46 from being inserted too far thereby causing the handle 54 to abut the side member 40 which would make the handle difficult to turn.

Resilient pads (not shown) can be placed on the inner faces of the side members to provide a tighter fit of the apparatus about the ladder leg.

Because the apparatus wraps itself about the ladder leg and is not bolted to the leg, it can be positioned so as to provide an infinite variety of extensions to the ladder leg. Hence, the extension is appropriate for any uneven surface.

While I have shown and described certain present preferred embodiments of the invention, it is to be distinctly understood that the invention is not limited thereto but may be otherwise variously embodied within the scope of the following claims.

I claim:

1. A ladder rail extension device comprising:

a. at least three bolts;

b. a pair of diametrically disposed L-shaped side members which together form a U-channel, one L-shaped member has at least three threaded holes sized to receive the bolts and the other L-shaped member has an equal number of larger holes, sized so as to permit a bolt to hang loosely from the side member when not engaged in a threaded hole;

c. a keeper attached to each bolt to prevent the bolt from slipping out of the oversized hole; and d. a hinge member attached to the side member to permit the U-channel to be opened in order to insert the ladder rail.

2. The ladder rail extension device in claim 1 having a resilient pad attached to an inside face of each side member which grips the ladder rail.

3. The ladder rail extension device in claim 1 wherein the hinge member is of the type having leaves which are slotted so that the hinge may be adjustably attached to the side members premitting an expansion of a width of the U-channel to accommodate ranging widths of ladder rails.

4. A ladder rail extension device comprising:

a. at least three bolts;

b. a pair of diametrically disposed L-shaped side members;

c. a pair of L-shaped flanges each extending from an L-shaped side member one flange having at least three threaded holes sized to receive the bolts and the other flange having an equal number of larger holes sized so as to permit a bolt to hang loosely from the flange when the bolt is not engaged in a threaded hole;

d. a keeper attached to each bolt to prevent the bolt from slipping out of the oversized hole; and e. a hinge member attached to the side members to permit the side members to move for ease of insert of the ladder rail between the side members.

* * * * *

UNITED STATES PATENT AND TRADEMARK OFFICE

CERTIFICATE OF CORRECTION

PATENT NO. : 4,143,742
DATED : March 13, 1979
INVENTOR(S) : Albert Fernandez

It is certified that error appears in the above-identified patent and that said Letters Patent are hereby corrected as shown below:

Column 2, line 11, after "distance" insert --between--.

Column 2, line 13, after "device", "ro" should read --to--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*